US007479941B2

(12) United States Patent
Matsumoto et al.

(10) Patent No.: US 7,479,941 B2
(45) Date of Patent: Jan. 20, 2009

(54) DISPLAY ELEMENT DRIVE APPARATUS AND IMAGE DISPLAY APPARATUS

(75) Inventors: Kazuya Matsumoto, Kyoto (JP); Yasuyuki Doi, Kyoto (JP)

(73) Assignee: Panasonic Corporation, Osaka (JP)

( * ) Notice: Subject to any disclaimer, the term of this patent is extended or adjusted under 35 U.S.C. 154(b) by 677 days.

(21) Appl. No.: 11/175,137

(22) Filed: Jul. 7, 2005

(65) Prior Publication Data

US 2006/0055653 A1 Mar. 16, 2006

(30) Foreign Application Priority Data

Sep. 13, 2004 (JP) ..... 2004-265139

(51) Int. Cl.
*G09G 3/36* (2006.01)

(52) U.S. Cl. ..... 345/98

(58) Field of Classification Search ..... 345/98, 345/99, 100, 212, 204, 213, 699; 327/65, 327/141, 144, 148, 158, 291, 296; 348/537, 348/572; 349/149, 150

See application file for complete search history.

(56) References Cited

U.S. PATENT DOCUMENTS 7,319,450 B2 * 1/2008 Choi ..... 345/92

7,327,344 B2 * 2/2008 Asada et al. ..... 345/100

FOREIGN PATENT DOCUMENTS

JP 11-249626 9/1999
JP 2002-176350 * 6/2002

* cited by examiner

*Primary Examiner*—Abbas I Abdulselam
(74) *Attorney, Agent, or Firm*—McDermott Will & Emery LLP

(57) ABSTRACT

In order to correctly hold a low-amplitude input signal even when the operating speed of a display element drive apparatus is high, a differential signal including a pair of CLKP1 and CLKN1 is input to a first comparator and a second comparator in a manner that provides opposite phases between respective output voltage signals. An output of the first comparator is frequency-divided by the first frequency dividing flip-flop, while an output of the second comparator is frequency-divided by the second frequency dividing flip-flop. A first data holding flip-flop holds an input data signal in synchronization with a signal output by a first frequency dividing flip-flop, while a second data holding flip-flop holds an input data signal in synchronization with a signal output by a second frequency dividing flip-flop.

17 Claims, 9 Drawing Sheets

DISPLAY ELEMENT DRIVE APPARATUS AND IMAGE DISPLAY APPARATUS

CROSS REFERENCE TO RELATED APPLICATIONS

This Nonprovisional application claims priority under 35 U.S.C. §119 (a) on Patent Application No. 2004-265139 filed in Japan on Sep. 13, 2004, the entire contents of which are hereby incorporated by reference.

BACKGROUND OF THE INVENTION

1. Field of the Invention

The present invention relates to a display element drive apparatus for driving a display element on a display panel of an image display apparatus. More particularly, the present invention relates to a semiconductor circuit technology for causing a display element drive apparatus to operate with high speed.

2. Description of the Prior Art

An image display apparatus comprising a display panel, such as a liquid crystal display panel or the like, is provided with a display element drive apparatus so as to drive a display element on the display panel. As such a display element drive apparatus, for example, a display element drive apparatus 500 illustrated in FIG. 1 is known (e.g., Japanese Unexamined Patent Publication No. H11-249626 (FIG. 2)).

In a display element drive apparatus, a timing of rising of a clock signal is used as a reference and, in addition, a timing of falling of the clock signal is also often used as a reference. Therefore, in the display element drive apparatus 500, clock signals which have opposite phases (signals N1 and N2 described below) are generated.

Specifically, the display element drive apparatus 500 comprises a comparator 501, an inverter 502, a first frequency dividing flop-flop 503, a second frequency dividing flip-flop 504, a delay circuit 505, a first data holding flip-flop 506, and a second data holding flip-flop 507.

The comparator 501 receives clock signals CLKP1 and CLKN1, which are low amplitude differential signals, through a positive-phase input terminal and a negative-phase input terminal thereof, respectively, and outputs a voltage signal (N1) corresponding to a potential difference between CLKP1 and CLKN1. As used herein, the term "low amplitude" means that the amplitude of a signal is small compared to a potential difference between a power source potential and a ground potential of the display element drive apparatus.

The inverter 502 inverts an output of the comparator 501 and outputs the inverted output to the second frequency dividing flip-flop 504.

The first frequency dividing flop-flop 503 frequency-divides the output signal N1 of the comparator 501. Specifically, as illustrated in FIG. 1, an inverted output NQ of the first frequency dividing flop-flop 503 is input to an input D of the first frequency dividing flop-flop 503. As a result, a signal obtained by frequency-dividing the output signal N1 is output from an output Q of the first frequency dividing flop-flop 503 at a timing of rising of the output signal N1 of the comparator 501. The output Q of the first frequency dividing flop-flop 503 is input to a clock CP of the first data holding flip-flop 506, and is used as a timing signal in the display element drive apparatus 500.

The second frequency dividing flip-flop 504 frequency-divides an output signal N2 of the inverter 502. Specifically, as illustrated in FIG. 1, an inverted output NQ of the second frequency dividing flip-flop 504 is input to an input D of the second frequency dividing flip-flop 504. As a result, a signal obtained by frequency-dividing the output signal N1 is output from an output Q of the second frequency dividing flip-flop 504 at a timing of falling of the output signal N1 of the comparator 501. The output Q of the second frequency dividing flip-flop 504 is used as a timing signal in the display element drive apparatus 500 as well as the output Q of the first frequency dividing flop-flop 503. Thus, in the display element drive apparatus 500, the timing of falling of the output signal N1 is used as an operation reference in addition to the timing of rising of the output signal N1.

The delay circuit 505 outputs an input data signal D1, which is obtained by delaying an input data signal DATA1, to the first data holding flip-flop 506 and the second data holding flip-flop 507. The delay circuit 505 is used to adjust a timing between the clock signal (the output Q), which is output by the first frequency dividing flop-flop 503 or the second frequency dividing flip-flop 504, and the input data signal DATA1.

The first data holding flip-flop 506 holds the input data signal D1 output by the delay circuit 505 at a rising edge of the output Q of the first frequency dividing flop-flop 503.

The second data holding flip-flop 507 holds the input data signal D1 output by the delay circuit 505 at a rising edge of the output Q of the second frequency dividing flip-flop 504. In other words, the first data holding flip-flop 506 and the second data holding flip-flop 507 have different timings of holding the input data signal D1.

However, in the conventional display element drive apparatus 500, the duty ratio of the output signal N1 of the comparator 501 may be significantly deteriorated, depending on conditions, such as frequency, power source voltage, process, and temperature.

If the duty ratio of the output signal N1 of the comparator 501 is significantly deteriorated, a relationship in phase between the output Q of the first frequency dividing flop-flop 503 and the output Q of the second frequency dividing flip-flop 504 is significantly deteriorated, so that there is a possibility that the first data holding flip-flop 506 and the second data holding flip-flop 507 cannot receive the output D1 of the delay circuit 505. Particularly, for example, when the display element drive apparatus operates with high speed, an erroneous operation is likely to occur.

Hereinafter, a change in each signal during an operation of the display element drive apparatus 500 will be described with reference to a timing chart of FIG. 2.

In the example, as illustrated in FIG. 2, the timing of rising of the output signal N1 of the comparator 501 is delayed by a delay time T1 from the timing of rising of the clock signal CLKP1. The timing of rising of the output signal N1 is also delayed by a delay time T2 from the timing of falling of the clock signal CLKP1.

In this case, a total delay time TS1 of rising of the output signal of the first frequency dividing flop-flop 503 is represented by:

$$\text{total delay time } TS1=(\text{delay time } T1+\text{delay time } T3)$$

where the delay time T3 is a delay time of the first frequency dividing flop-flop 503 itself.

Also, a total delay time TS2 of rising of the output signal of the second frequency dividing flip-flop 504 is represented by:

$$\text{total delay time } TS2=(\text{delay time } T2+\text{delay time } T4+\text{delay time } T5)$$

where the delay time T4 is a delay time from when a signal is input to the inverter 502 to when the signal is output there-from, and the delay time T5 is a delay time of the second frequency dividing flip-flop 504 itself.

In this case, if characteristics of the comparator 501 are changed, depending on conditions, such as frequency, power source voltage, process, and temperature, the delay time T1 is not equal to the delay time T2. As a result, the duty ratio (a ratio of a HIGH interval and a LOW interval) of the output signal N1 of the comparator 501 is deviated. Also, characteristics of the inverter 502 are changed, depending on conditions, such as frequency, power source voltage, process, and temperature, so that the delay time T4 from the input to the output of the inverter 502 is changed. Therefore, a significant difference is expected between the total delay time TS1 and the total delay time TS2.

Here, a setup time and a hold time for a HIGH level of the input data signal DATA1 are represented by S1 and H1, respectively. A delay time of rising of the input data signal D1 is represented by T6. A delay time of falling of the input data signal D1 is represented by T7. In this case, the total delay time TS1 is substantially equal to or larger than the delay time T6. Therefore, the first data holding flip-flop 506 can hold HIGH-level data (the input data signal D1).

On the other hand, the total delay time TS2 may be larger than a delay time which is a sum of the delay time T7 and the hold time H1. Therefore, in this case, the second data holding flip-flop 507 cannot hold HIGH-level data (the input data signal D1).

As described above, in the conventional display element drive apparatus 500, when the timing of falling as well as the timing of rising of a clock signal are used as references so as to receive data in an internal circuit, data may not be correctly received. It is expected that this problem becomes more significant, as the operating speed of the display element drive apparatus 500 is increased.

SUMMARY OF THE INVENTION

The present invention is provided to solve the above-described problem. An object of the present invention is to provide a display element drive apparatus capable of correctly holding an input data signal even when the operating speed of the display element drive apparatus is high.

To solve the above-described problems, the present invention provides a display element drive apparatus for driving a display element formed on a display panel, comprising:

a first comparator having a positive-phase input terminal and a negative-phase input terminal, wherein a differential signal includes a pair of a first clock signal and a second clock signal, the first clock signal is input to the positive-phase input terminal, and the second clock signal is input to the negative-phase input terminal, and a voltage signal corresponding to a potential difference between the first clock signal and the second clock signal is output as a first reference clock signal;

a second comparator having a positive-phase input terminal and a negative-phase input terminal, wherein the second clock signal is input to the positive-phase input terminal and the first clock signal is input to the negative-phase input terminal, and a voltage signal corresponding to a potential difference between the second clock signal and the first clock signal is output as a second reference clock signal;

a first hold circuit of holding a data signal input in synchronization with the first reference clock signal; and a second hold circuit of holding a data signal input in synchronization with the second reference clock signal.

According to an embodiment of the present invention, the display element drive apparatus further comprises:

a delay circuit of delaying an input data signal, wherein the first hold circuit receives the data signal delayed by the delay circuit, and the second hold circuit receives the data signal delayed by the delay circuit.

Thereby, even if the duty ratio (a ratio of a HIGH interval and a LOW interval) of the first reference clock signal output by the first comparator and the duty ratio of the second reference clock signal output by the second comparator are deviated, the degree of deviation is substantially the same between the two comparators. Therefore, the first hold circuit and the second hold circuit stably hold an input data signal.

According to an embodiment of the present invention, in the display element drive apparatus, an amplitude of the first clock signal and an amplitude of the second clock signal are each smaller than a potential difference between a power source potential and a ground potential of the display element drive apparatus.

Thereby, power consumption during transmission of a clock signal to the display element drive apparatus can be reduced.

According to an embodiment of the present invention, in the display element drive apparatus, the first comparator and the second comparator have the same circuit structure.

Thereby, the first hold circuit and the second hold circuit more stably hold an input data signal.

According to an embodiment of the present invention, the display element drive apparatus further comprises:

a third comparator, wherein a differential signal includes a pair of a first data signal and a second data signal, and a voltage signal corresponding to a potential difference between the first data signal and the second data signal as the data signal; and a delay circuit of delaying the data signal output by the third comparator, wherein the first hold circuit receives the data signal delayed by the delay circuit, and the second hold circuit receives the data signal delayed by the delay circuit.

Thereby, power consumption during transmission of a data signal to the display element drive apparatus can be reduced.

According to an embodiment of the present invention, in the display element drive apparatus, the first comparator, the second comparator and the third comparator have the same circuit structure.

Thereby, a delay time is substantially the same between the first comparator, the second comparator and the third comparator, so that the first hold circuit and the second hold circuit more stably hold a data signal.

According to an embodiment of the present invention, the display element drive apparatus further comprises:

a third comparator having a positive-phase input terminal and a negative-phase input terminal, wherein a differential signal includes a pair of a first data signal and a second data signal, the first data signal is input to the positive-phase input terminal, and the second data signal is input to the negative-phase input terminal, and a voltage signal corresponding to a potential difference between the first data signal and the second data signal is output;

a fourth comparator having a positive-phase input terminal and a negative-phase input terminal, wherein the second data signal is input to the positive-phase input terminal and the first data signal is input to the negative-phase input terminal, and a voltage signal corresponding to a potential difference between the second data signal and the first data signal is output;

a first delay circuit of delaying the signal output by the third comparator and outputting the delayed signal as a data signal for the first hold circuit; and a second delay circuit of delaying the signal output by the fourth comparator and outputting the delayed signal as a data signal for the second hold circuit.

Thereby, even if the duty ratio of the data signal output by the third comparator and the duty ratio of the data signal output by the fourth comparator are deviated, the degree of deviation is substantially the same between the two comparators. Therefore, the first hold circuit and the second hold circuit stably hold an input data signal.

According to an embodiment of the present invention, in the display element drive apparatus, the first comparator, the second comparator, the third comparator and the fourth comparator having the same circuit structure.

Thereby, a delay time is substantially the same between the first comparator, the second comparator, the third comparator and the fourth comparator, so that the first hold circuit and the second hold circuit more stably hold a data signal.

According to an embodiment of the present invention, in the display element drive apparatus, an amplitude of the first data signal and an amplitude of the second data signal are each smaller than a potential difference between a power source potential and a ground potential of the display element drive apparatus.

Thereby, power consumption during transmission of a clock signal to the display element drive apparatus can be reduced.

According to an embodiment of the present invention, an image display apparatus comprises:

a display panels comprising a plurality of image display elements;

a plurality of display element drive apparatuses for driving the image display element on the display panel, and a control circuit for controlling operations of the plurality of display element drive apparatuses, wherein at least one of the plurality of display element drive apparatuses comprises:

a first comparator having a positive-phase input terminal and a negative-phase input terminal, wherein a differential signal includes a pair of a first clock signal and a second clock signal, the first clock signal is input to the positive-phase input terminal, and the second clock signal is input to the negative-phase input terminal, and a voltage signal corresponding to a potential difference between the first clock signal and the second clock signal is output as a first reference clock signal;

a second comparator having a positive-phase input terminal and a negative-phase input terminal, wherein the second clock signal is input to the positive-phase input terminal and the first clock signal is input to the negative-phase input terminal, and a voltage signal corresponding to a potential difference between the second clock signal and the first clock signal is output as a second reference clock signal;

a first hold circuit of holding a data signal input in synchronization with the first reference clock signal; and a second hold circuit of holding a data signal input in synchronization with the second reference clock signal.

According to an embodiment of the present invention, the at least one display element drive apparatus further comprises:

a delay circuit of delaying an input data signal, wherein the first hold circuit receives the data signal delayed by the delay circuit, and the second hold circuit receives the data signal delayed by the delay circuit.

According to an embodiment of the present invention, in the image display apparatus, an amplitude of the first clock signal and an amplitude of the second clock signal are each smaller than a potential difference between a power source potential and a ground potential of the display element drive apparatus.

According to an embodiment of the present invention, in the image display apparatus, the first comparator and the second comparator have the same circuit structure.

According to an embodiment of the present invention, the at least one display element drive apparatus further comprises:

a third comparator, wherein a differential signal includes a pair of a first data signal and a second data signal, and a voltage signal corresponding to a potential difference between the first data signal and the second data signal as the data signal; and a delay circuit of delaying the data signal output by the third comparator, wherein the first hold circuit receives the data signal delayed by the delay circuit, and the second hold circuit receives the data signal delayed by the delay circuit.

According to an embodiment of the present invention, in the image display apparatus, the first comparator, the second comparator and the third comparator have the same circuit structure.

According to an embodiment of the present invention, the at least one display element drive apparatus further comprises:

a third comparator having a positive-phase input terminal and a negative-phase input terminal, wherein a differential signal includes a pair of a first data signal and a second data signal, the first data signal is input to the positive-phase input terminal, and the second data signal is input to the negative-phase input terminal, and a voltage signal corresponding to a potential difference between the first data signal and the second data signal is output;

a fourth comparator having a positive-phase input terminal and a negative-phase input terminal, wherein the second data signal is input to the positive-phase input terminal and the first data signal is input to the negative-phase input terminal, and a voltage signal corresponding to a potential difference between the second data signal and the first data signal is output;

a first delay circuit of delaying the signal output by the third comparator and outputting the delayed signal as a data signal for the first hold circuit, and a second delay circuit of delaying the signal output by the fourth comparator and outputting the delayed signal as a data signal for the second hold circuit.

According to an embodiment of the present invention, in the image display apparatus, the first comparator, the second comparator, the third comparator and the fourth comparator having the same circuit structure.

According to an embodiment of the present invention, in the image display apparatus, an amplitude of the first data signal and an amplitude of the second data signal are each smaller than a potential difference between a power source potential and a ground potential of the at least one display element drive apparatus.

Thereby, a low-amplitude input signal can be correctly held, so that a high-speed display operation can be performed, resulting in an image display apparatus capable of providing stable display which does not cause discomfort, such as flicker or the like, to the viewer.

According to an embodiment of the present invention, in the image display apparatus, the display panel, the plurality of display element drive apparatuses, and the control circuit are formed on the same substrate.

Thereby, it is possible to reduce the manufacturing cost of the image display apparatus and the size of the display panel.

DETAILED DESCRIPTION OF THE PREFFERED EMBODIMENT

Hereinafter, embodiments of the present invention will be described with reference to the accompanying drawings.

Embodiment 1

Figure 1:
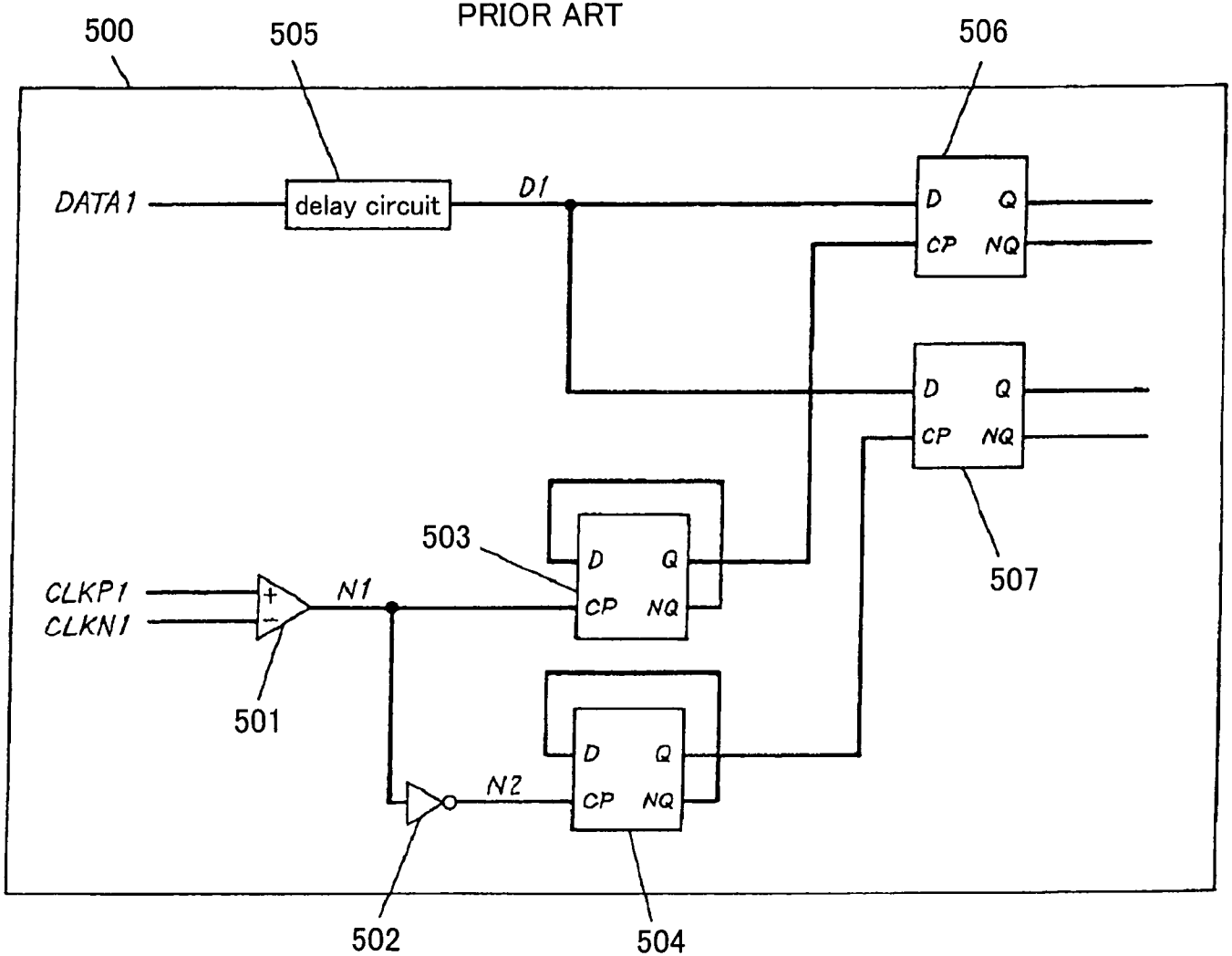
FIG.1 PRIOR ART
FIG. 1 is a block diagram illustrating a structure of a conventional display element drive apparatus.
Figure 2:
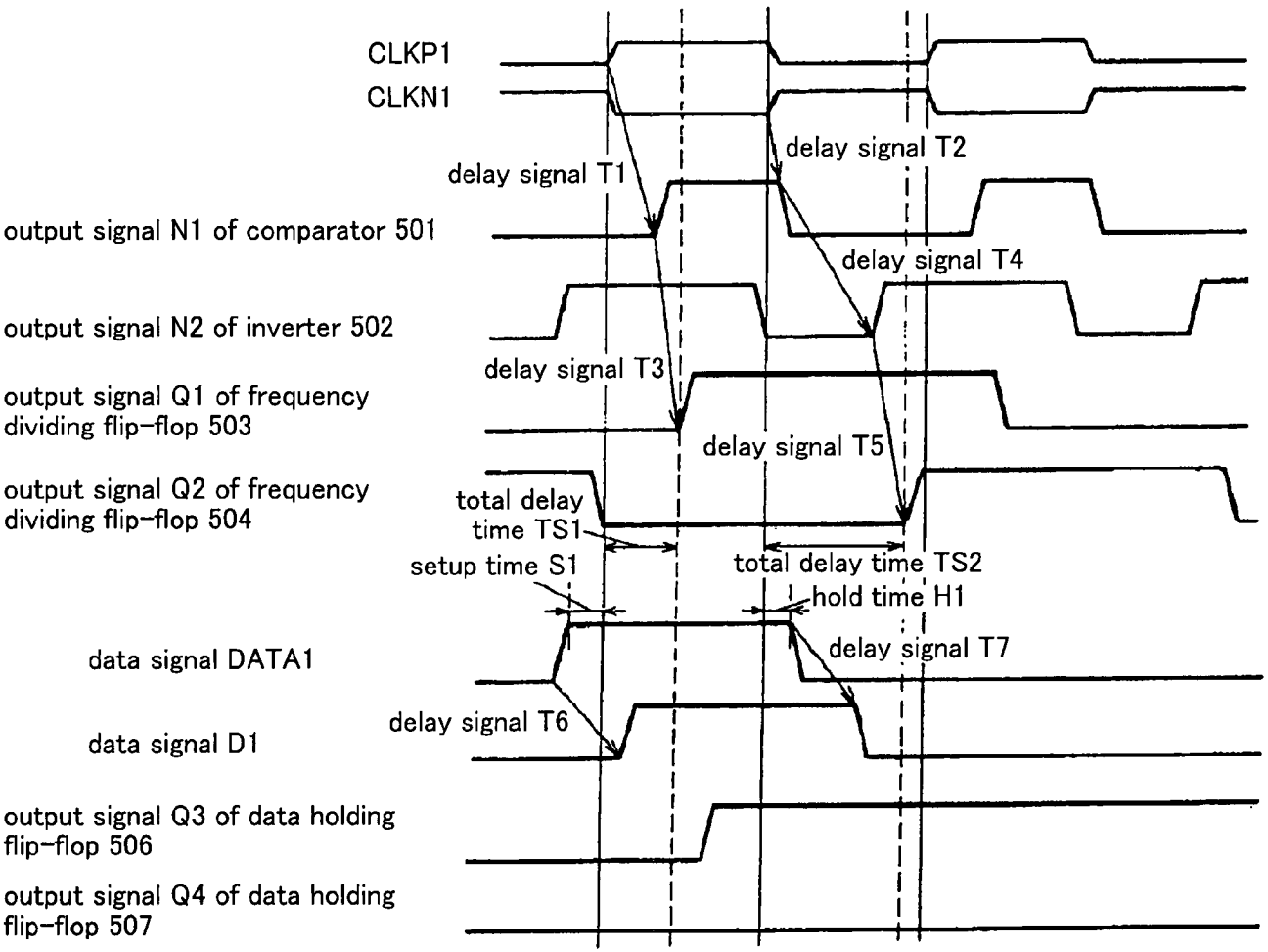
FIG. 2 is a timing chart of signals in the conventional display element drive apparatus of FIG. 1.
Figure 3:
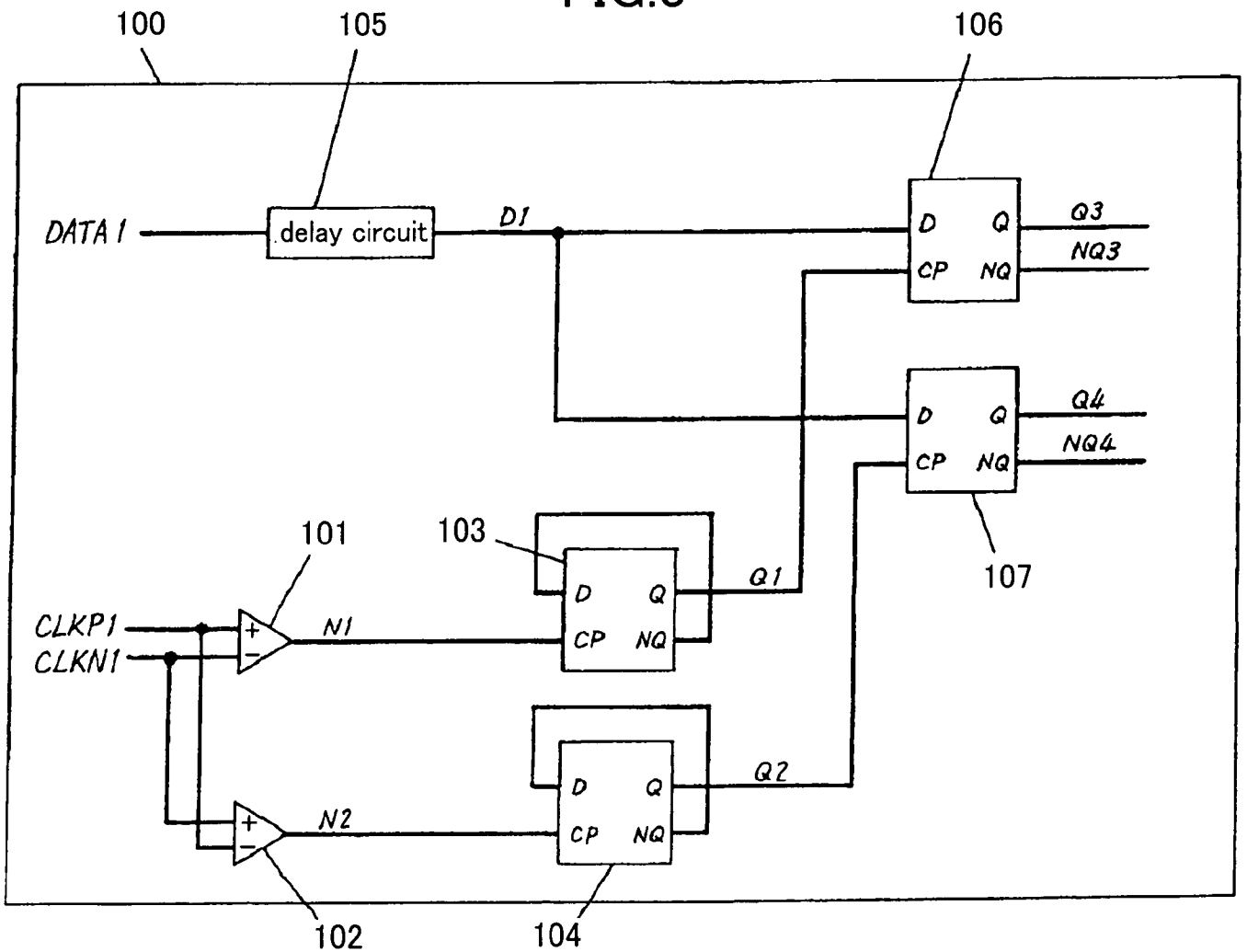
FIG. 3 is a block diagram illustrating a structure of a display element drive apparatus according to Embodiment 1 of the present invention.

FIG. 3 is a block diagram illustrating a structure of a display element drive apparatus 100 according to Embodiment 1 of the present invention. As illustrated in FIG. 3, the display element drive apparatus 100 comprises a first comparator 101, a second comparator 102, a first frequency dividing flip-flop 103, a second frequency dividing flip-flop 104, a delay circuit 105, a the first data holding flip-flop 106, and a second data holding flip-flop 107.

A differential signal includes a clock signal CLKP1 and a clock signal CLKN1, each of which has a low amplitude. The first comparator 101 receives CLKP1 through a positive-phase input terminal thereof and CLKN1 through a negative-phase input terminal thereof. Thereafter, the first comparator 101 outputs a voltage signal (N1) corresponding to a potential difference between CLKP1 and CLKN1 to the first frequency dividing flip-flop 103.

The second comparator 102 receives CLKN1 through a positive-phase input terminal thereof and CLKP1 through a negative-phase input terminal thereof. Thereafter, the second comparator 102 outputs a voltage signal (N2) corresponding to a potential difference between CLKN1 and CLKP1 to the second frequency dividing flip-flop 104.

Thus, each of CLKP1 and CLKN1 is input to the opposite-phase input terminals of the first comparator 101 and the second comparator 102, i.e., the first comparator 101 and the second comparator 102 receive CLKP1 and CLKN1 in a manner that provides opposite phases (opposite polarities) between respective output voltage signals.

In Embodiment 1, the first comparator 101 and the second comparator 102 have the same circuit structure. Therefore, even if the duty ratio of the HIGH interval to the LOW interval of the output signal (N1, N2) of each comparator is deviated due to conditions, such as frequency, power source voltage, process, and temperature, the degree of deviation is substantially the same between the two comparators.

The first frequency dividing flip-flop 103 frequency-divides the output signal N1 of the first comparator 101 and outputs a resultant clock signal Q1 having ½ of a frequency of the output signal N1.

The second frequency dividing flip-flop 104 frequency-divides the output signal N2 of the second comparator 102 and outputs a resultant clock signal Q2 having ½ of a frequency of the output signal N2.

The delay circuit 105 delays the input data signal DATA1 and outputs a resultant delayed signal (input data signal D1) to the first data holding flip-flop 106 and the second data holding flip-flop 107. The delay circuit 105 is used to adjust a timing between each of the clock signal Q1 and the clock signal Q2, and the input data signal DATA1.

The first data holding flip-flop 106 holds the input data signal D1 output by the delay circuit 105 at a rising edge of the clock signal Q1.

The second data holding flip-flop 107 holds the input data signal D1 output by the delay circuit 105 at a rising edge of the clock signal Q2.

Note that, in Embodiment 1 and Embodiment 2 which will be described after Embodiment 1, an output Q3 of the first data holding flip-flop 106 and an output Q4 of the second data holding flip-flop 107 are used to drive a display element on a display panel.

The low-amplitude differential signals CLKP1 and CLKN1 will be briefly described. The differential signals CLKP1 and CLKN1 are input as signals having a predetermined amplitude with respect to a reference voltage. In a preferable embodiment, the reference voltage is 0.5 V to 1.5 V, and the differential signals CLKP1 and CLKN1 have an amplitude of ±35 mV to ±100 mV. A power source voltage used in the display element drive apparatus 100 is 2.0 V to 3.6 V. Thus, the amplitudes of the differential signals CLKP1 and CLKN1 are small with respect to the power source voltage. Therefore, the differential signals CLKP1 and CLKN1 are referred to as low amplitude signals. Use of the low amplitude signals has an advantage of reducing power consumption during signal transmission, for example.

Next, an operation of the display element drive apparatus 100 thus constructed will be described.

Figure 4:
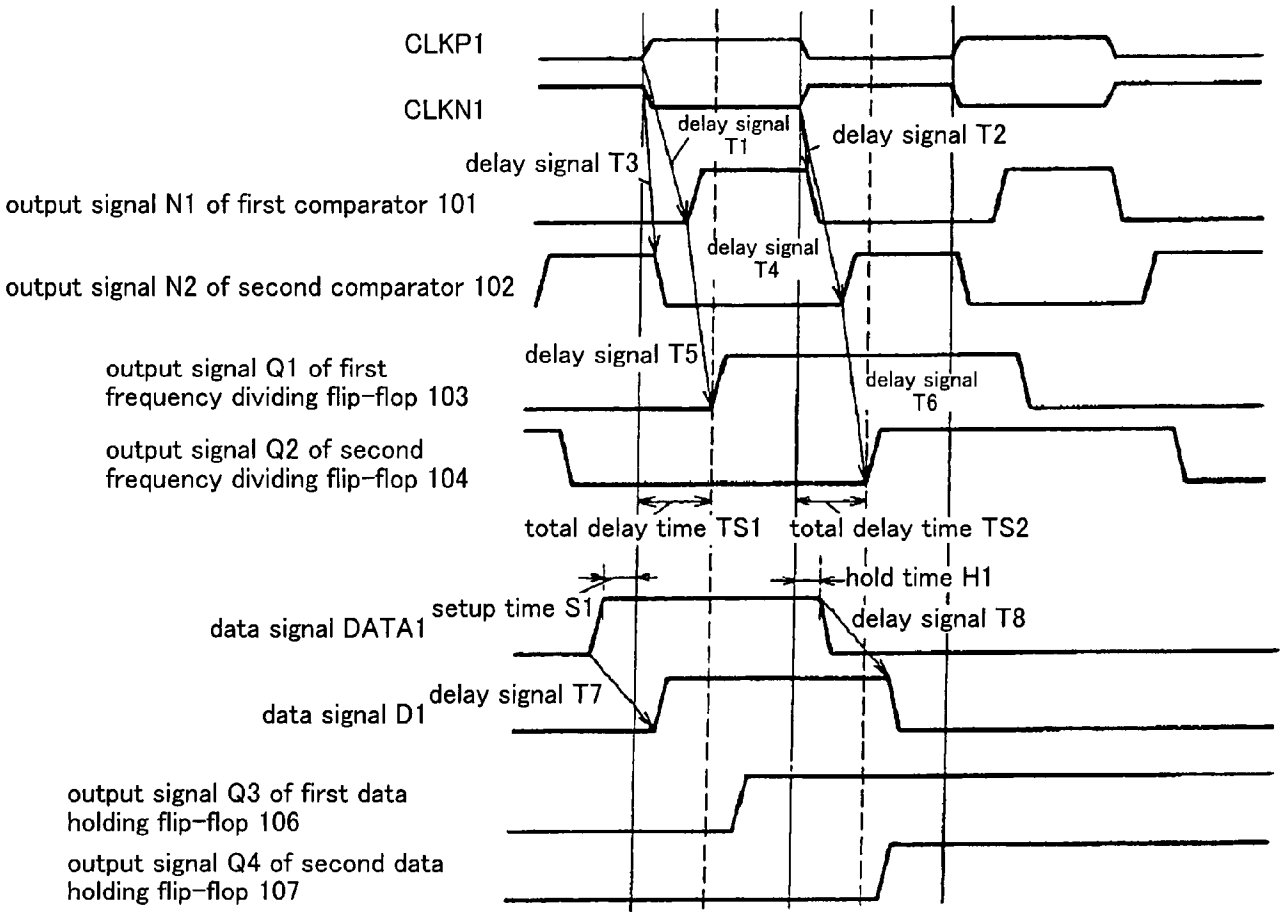
FIG. 4 is a timing chart of signals in the display element drive apparatus of Embodiment I of the present invention.

When the first comparator 101 and the second comparator 102 receive the differential signals CLKP1 and CLKN1, the first comparator 101 outputs the output signal N1. In Embodiment 1, as illustrated in FIG. 4, a timing of rising of the output signal N1 is delayed by a delay time T1 from a timing of rising of CLKP1, and a timing of falling of the output signal N1 is delayed by a delay time T2 from a timing of falling of CLKP1.

The second comparator 102 outputs the output signal N2. A timing of falling of the output signal N2 is delayed by a delay time T3 from a timing of falling of CLKN1, and a timing of rising of the output signal N2 is delayed by a delay time T4 from a timing of rising of CLKN1.

In Embodiment 1, since the first comparator 101 and the second comparator 102 have the same circuit structure, it is considered that the delay time T1 and the delay time T4 are substantially the same delay time, and the delay time T2 and the delay time T3 are substantially the same delay time.

Next, the output signal N1 of the first comparator 101 is frequency-divided to ½ by the first frequency dividing flip-flop 103. The output signal N2 of the second comparator 102 is frequency-divided to ½ by the second frequency dividing flip-flop 104.

In this case, a total delay time TS1 of rising of the output clock signal Q1 of the first frequency dividing flop-flop 103 is represented by:

$$\text{total delay time } TS1=(\text{delay time } T1+\text{delay time } T5)$$

where the delay time T5 is a delay time of the first frequency dividing flop-flop 103 itself.

Also, a total delay time TS2 of rising of the output clock signal Q2 of the second frequency dividing flip-flop 104 is represented by:

$$\text{total delay time } TS2=(\text{delay time } T4+\text{delay time } T5)$$

where the delay time T6 is a delay time of the second frequency dividing flip-flop 104 itself.

In this case, when the first frequency dividing flip-flop 103 and the second frequency dividing flip-flop 104 have the same circuit structure, the delay time T5 and the delay time T6 are substantially the same.

Therefore, as described above, when the delay time T1 and the delay time T4 are substantially the same, the total delay time TS1 and the total delay time TS2 are substantially the same.

The input data signal DATA1 is delayed by the delay circuit 105 and is output as the input data signal D1 to the first data holding flip-flop 106 and the second data holding flip-flop 107.

The first data holding flip-flop 106 performs a hold operation with respect to the input data signal D1 at a rising edge of the clock signal Q1 output by the first frequency dividing flip-flop 103. As illustrated in FIG. 4, a setup time and a hold time for a HIGH level of the input data signal DATA1 are represented by S1 and H1, respectively. A delay time of rising of the input data signal D1 is represented by T7. A delay time of falling of the input data signal D1 is represented by T8. In this case, the total delay time TS1 is substantially equal to or larger than the delay time T7. Therefore, the first data holding flip-flop 106 can hold HIGH-level data (the input data signal D1).

The second data holding flip-flop 107 performs a hold operation with respect to the input data signal D1 at a rising edge of the clock signal Q2 output by the second frequency dividing flip-flop 104. In this case, the total delay time TS2 is substantially equal to or larger than the delay time T8 of falling of the input data signal D1. Therefore, the second data holding flip-flop 107 can also hold HIGH-level data.

As described above, according to Embodiment 1, an input data signal can be correctly held even when there is an influence, such as frequency, power source voltage, process, or temperature. Therefore, the display element drive apparatus of Embodiment 1 can operate with high speed.

Embodiment 2

An apparatus according to Embodiment 2 of the present invention will be described in which power consumption during transmission of an input data signal can be reduced to a further extent than in Embodiment 1.

Figure 5:
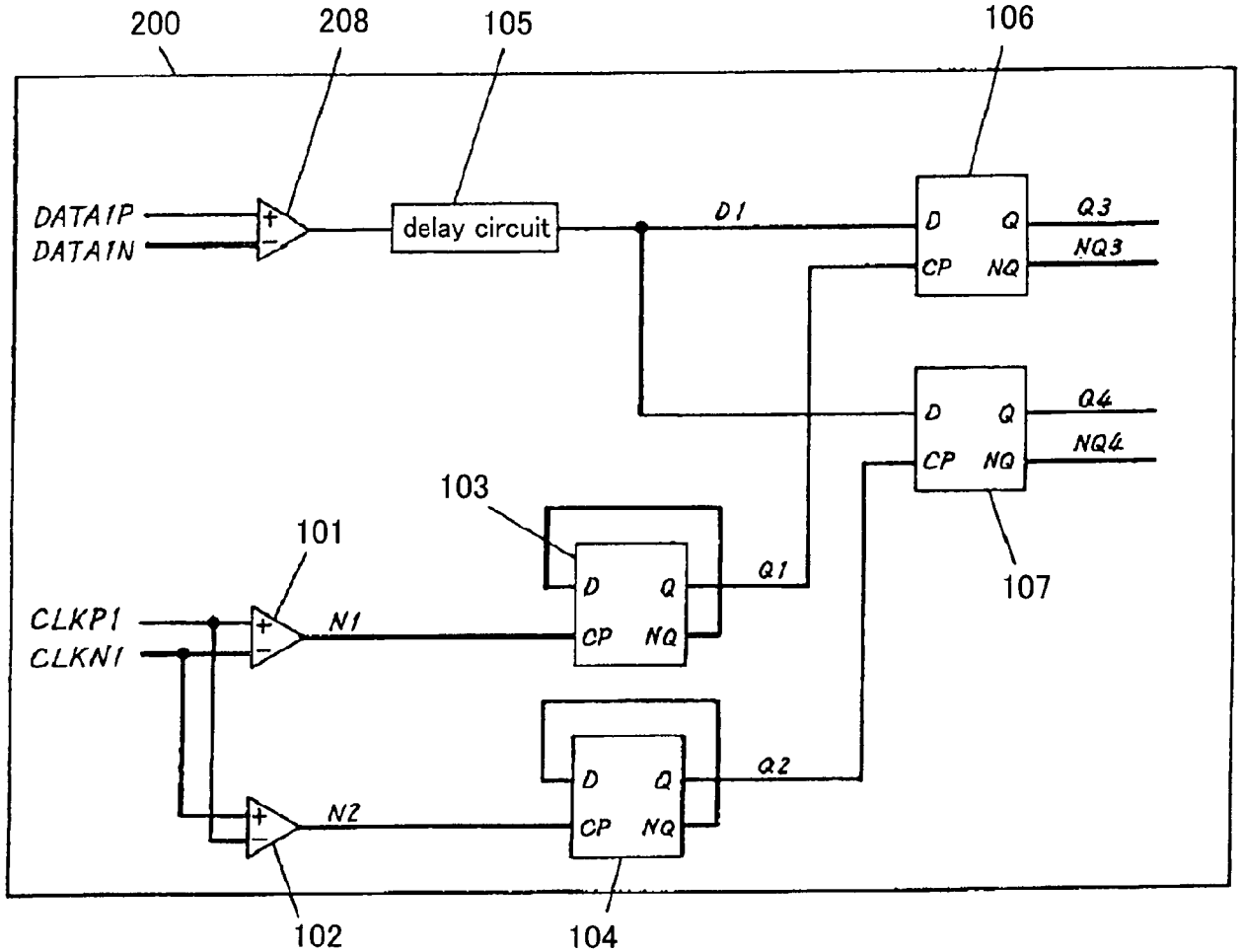
FIG. 5 is a block diagram illustrating a structure of a display element drive apparatus according to Embodiment 2 of the present invention.

FIG. 5 is a block diagram illustrating a structure of a display element drive apparatus 200 according to Embodiment 2 of the present invention. The display element drive apparatus 200 is different from the display element drive apparatus 100 of Embodiment 1 in that a data comparator 208 is additionally provided. Note that components of embodiments described below which have a function similar to that of Embodiment 1 are indicated with the same reference numerals and will not be explained.

The data comparator 208 outputs a voltage signal corresponding to a potential difference between DATA1P and DATA1N, which are input low-amplitude differential signals, to a delay circuit 105. Specifically, in Embodiment 2, the signal output by the data comparator 208 is output as an input data signal D1 via the delay circuit 105.

In the display element drive apparatus 200 thus constructed, a first frequency dividing flip-flop 103 outputs a clock signal Q1 in a manner similar to that of the display element drive apparatus 100 of Embodiment 1. Also, a second frequency dividing flip-flop 104 outputs a clock signal Q2. Also in the display element drive apparatus 200, a first comparator 101 and a second comparator 102 have the same circuit structure, so that the delay time T1 and the delay time T4 are substantially the same delay time.

Therefore, also in Embodiment 2, a total delay time TS1 (a total delay time of rising of the clock signal Q1) and a total delay time TS2 (a total delay time of rising of the clock signal Q2) are substantially the same.

The data comparator 208 outputs a signal corresponding to a potential difference between DATA1P and DATA1N, which are input as differential signals. The output of the data comparator 208 is delayed by the delay circuit 105 and is then output as the input data signal D1 to a first data holding flip-flop 106 and a second data holding flip-flop 107.

Figure 6:
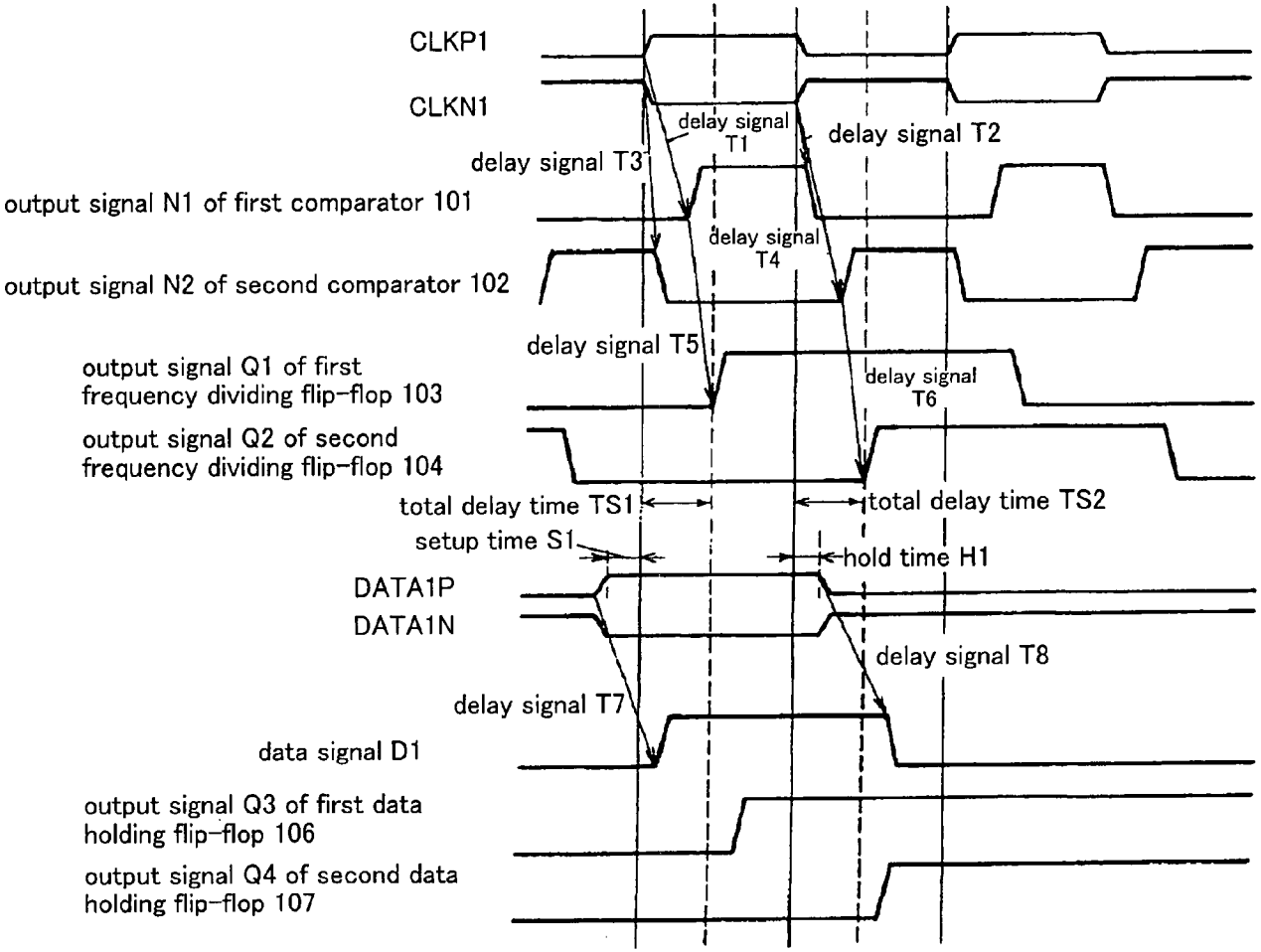
FIG. 6 is a timing chart of signals in the display element drive apparatus of Embodiment 2 of the present invention.

The first data holding flip-flop 106 performs a hold operation with respect to the input data signal D1 at a rising edge of the clock signal Q1 output by the first frequency dividing flip-flop 103. As illustrated in FIG. 6, a setup time and a hold time for a HIGH level of the input data signal DATA1P are represented by S1 and H1, respectively. A delay time of rising of the input data signal D1 is represented by T7. A delay time of falling of the input data signal D1 is represented by T8. In this case, the total delay time TS1 is substantially equal to or larger than the delay time T7. Therefore, the first data holding flip-flop 106 can hold HIGH-level data (the input data signal D1).

The second data holding flip-flop 107 performs a hold operation with respect to the input data signal D1 at a rising edge of the clock signal Q2 output by the second frequency dividing flip-flop 104. In this case, the total delay time TS2 is substantially equal to or larger than the delay time T8 of falling of the input data signal D1. Therefore, also in Embodiment 2, the second data holding flip-flop 107 can also hold HIGH-level data (the input data signal D1).

As described above, also in Embodiment 2, the display element drive apparatus 200 can correctly hold an input data signal even when there is an influence, such as frequency, power source voltage, process, or temperature. Therefore, the display element drive apparatus of Embodiment 2 can operate with high speed.

In addition, the input data signals (DATA1P and DATA1N) are low-amplitude differential signals similar to the clock signals CLKP1 and CLKN1, so that power consumption during transmission of the input data signal can be reduced.

Note that, in Embodiment 2, the first data holding flip-flop 106 and the second data holding flip-flop 107 receive the same data signal from the single data comparator 208. Alternatively, for example, a data input comparator may be connected to each data holding flip-flop so that an input data signal is input to the data holding flip-flop.

Embodiment 3

Figure 7:
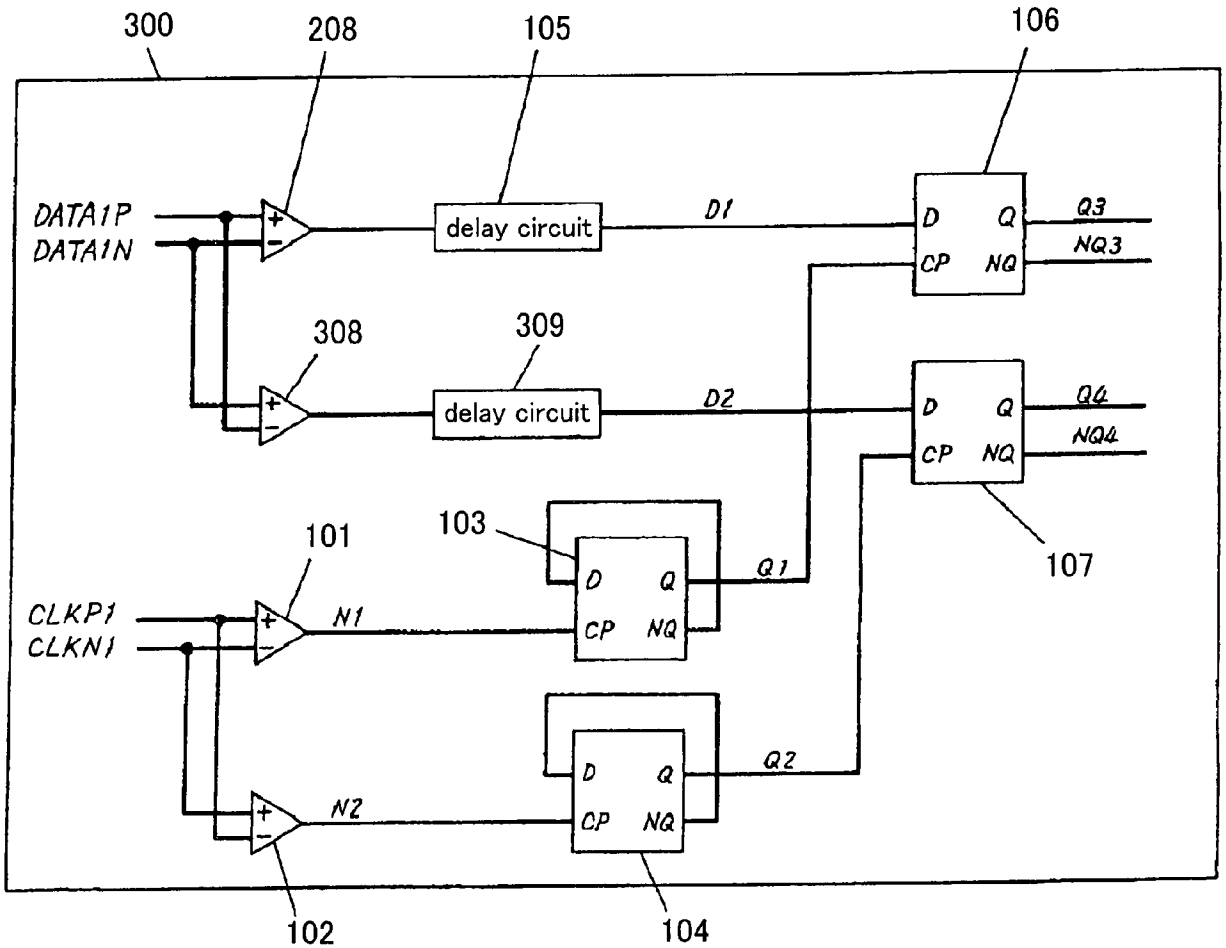
FIG. 7 is a block diagram illustrating a structure of a display element drive apparatus according to Embodiment 3 of the present invention.

FIG. 7 is a block diagram illustrating a structure of a display element drive apparatus 300 according to Embodiment 3 of the present invention. In Embodiment 3, a first data holding flip-flop 106 and a second data holding flip-flop 107 hold a relationship between opposite phases of input data signals (D1 and D2).

Specifically, as illustrated in FIG. 7, the display element drive apparatus 300 is different from the display element drive apparatus 200 in that a data comparator 308 and a delay circuit 309 are further provided.

The data comparator 308 receives DATA1P through a negative-phase input terminal thereof and DATA1N through a positive-phase input terminal thereof. In other words, the data comparator 208 and the data comparator 308 receive DATA1P and DATA1N in a manner that provides opposite phases (opposite polarities) between respective output voltage signals.

In Embodiment 3, the data comparator 308 and the data comparator 208 have the same circuit structure. Therefore, in Embodiment 3, even if characteristics of the data comparator 208 and the data comparator 308 are changed due to conditions, such as frequency, power source voltage, process, and temperature, the degree of deviation in duty ratio is substantially the same between the two comparators.

The delay circuit 309 is a circuit for adjusting a timing between a clock signal Q2 and an input data signal D2. To achieve this, the delay circuit 309 delays an output of the data comparator 308 and outputs the delayed output to the second data holding flip-flop 107. In Embodiment 3, the second data holding flip-flop 107 holds the output (input data signal D2) of the delay circuit 309.

Note that, in Embodiment 3, an output Q3 of the first data holding flip-flop 106 and an output NQ4 (inverted output) of the second data holding flip-flop 107 are used to drive a display element on a display panel.

Next, an operation of the display element drive apparatus 300 thus constructed will be described.

Also in the display element drive apparatus 300, a first frequency dividing flip-flop 103 outputs a clock signal Q1 in a manner similar to that of the display element drive apparatus 100 of Embodiment 1. Also, a second frequency dividing flip-flop 104 outputs a clock signal Q2. Also in the display element drive apparatus 300, a first comparator 101 and a second comparator 102 have the same circuit structure, so that the delay time T1 and the delay time T4 are substantially the same delay time.

Therefore, also in Embodiment 3, a total delay time TS1 (a total delay time of rising of the clock signal Q1) and a total delay time TS2 (a total delay time of rising of the clock signal Q2) are substantially the same.

The data comparator 208 outputs a signal corresponding to a potential difference between DATA1P and DATA1N which are input as differential signals. An output of the data comparator 208 is delayed by a delay circuit 105, and the resultant delayed output is input as an input data signal D1 to the first data holding flip-flop 106.

The data comparator 308 outputs a signal corresponding to a potential difference between DATA1N and DATA1P which are input as differential signals. An output of the data comparator 308 is delayed by the delay circuit 309, and the resultant delayed output is input as the input data signal D2 to the second data holding flip-flop 107.

Figure 8:
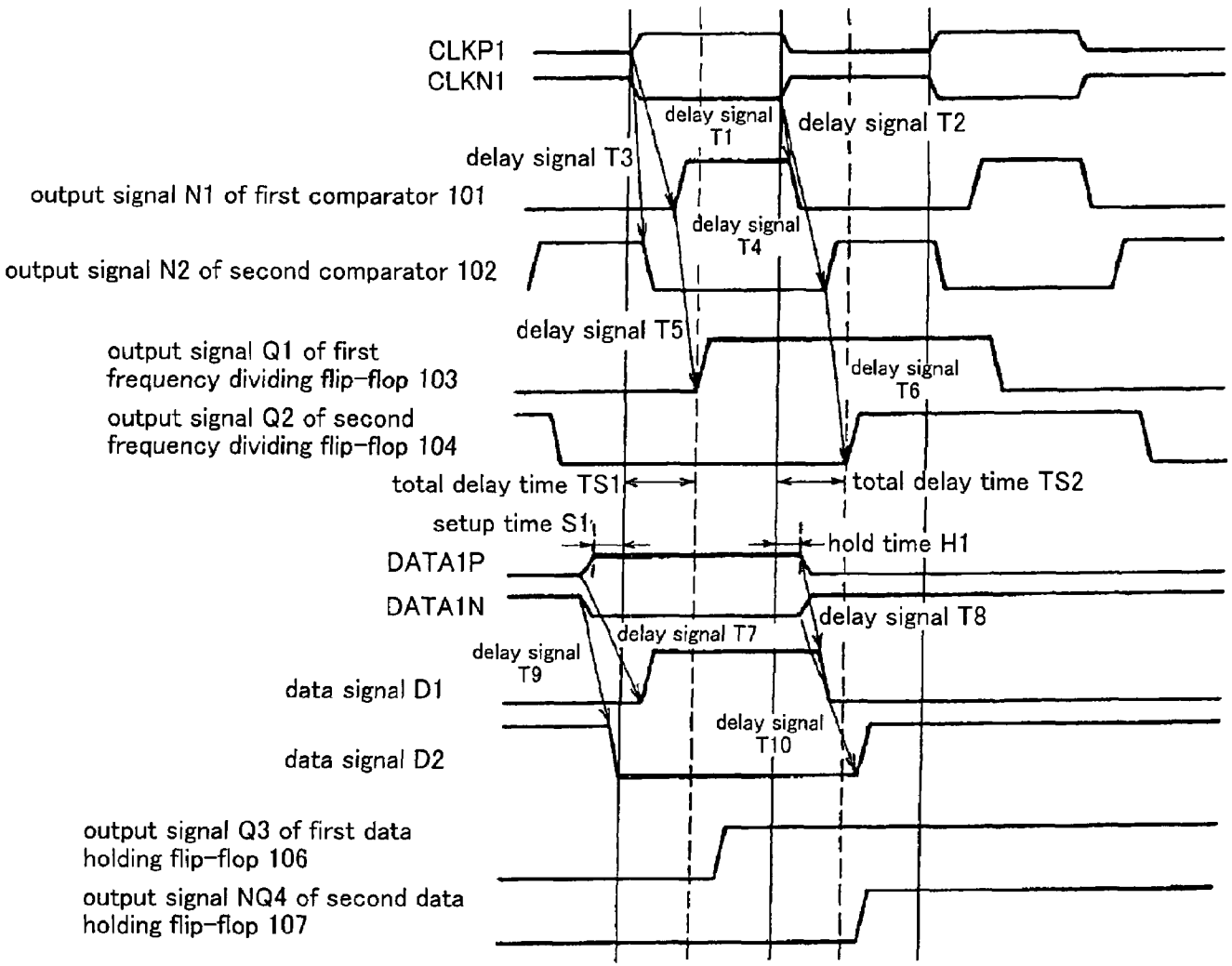
FIG. 8 is a timing chart of signals in the display element drive apparatus of Embodiment 3 of the present invention.

The first data holding flip-flop 106 performs a hold operation with respect to the input data signal D1 at a rising edge of the clock signal Q1 output by the first frequency dividing flip-flop 103. As illustrated in FIG. 8, a setup time and a hold time for a HIGH level of the input data signal DATA1P are represented by S1 and H1, respectively. A delay time of rising of the input data signal D1 is represented by T7. A delay time of falling of the input data signal D1 is represented by T8. In this case, the total delay time TS1 is substantially equal to or larger than the delay time T7. Therefore, the first data holding flip-flop 106 can hold HIGH-level data (the input data signal D1).

The second data holding flip-flop 107 performs a hold operation with respect to the input data signal D1 at a rising edge of the clock signal Q2 output by the second frequency dividing flip-flop 104. In this case, when the data comparator 208 and the data comparator 308 have the same circuit structure, a delay time T10 of rising of the input data signal D2 is substantially the same as the delay time T7, and a delay time T9 of falling of the input data signal D2 is substantially the same as the delay time T8. The total delay time TS2 is substantially equal to or larger than the delay time T8 of falling of the input data signal D1. Therefore, the second data holding flip-flop 107 can also hold HIGH-level data (input data signal D2).

Therefore, also in Embodiment 3, the first data holding flip-flop 106 and the second data holding flip-flop 107 can reliably hold an input data signal.

Further, as in the display element drive apparatus 200, the input data signals DATA1P and DATA1N are low-amplitude differential signals, so that power consumption during transmission of the input data signal can be reduced.

In addition, if the duty ratios of the output signals (D1 and D2) are significantly deviated in the data comparator 208 and the data comparator 308, it is considered that the delay time of rising or falling is the same between the input data signal D1 reaching the first data holding flip-flop 106 and the input data signal D2 reaching the second data holding flip-flop 107. Therefore, data can be more easily held in the first data holding flip-flop 106 and the second data holding flip-flop 107.

Note that, in Embodiments 1 to 3, the frequency dividing flip-flops and the data holding flip-flops are connected together with one-to-one correspondence. The present invention is not limited to this. For example, in a display element drive apparatus comprising a plurality of pairs of the first data holding flip-flop 106 and the second data holding flip-flop 107, outputs of a pair of the first frequency dividing flip-flop 103 and the second frequency dividing flip-flop 104 may be used as reference clock signals.

Further, a plurality of pairs of two comparators (the first comparator 101 and the second comparator 102 of Embodiment 1) to which CLKP1 and CLKN1 are respectively input may be provided. In this case, the pairs of the comparators may receive different differential signals.

An output signal of each comparator (the first comparator 101, etc.) may be used as a clock signal for a plurality of frequency dividing flip-flops.

Embodiment 4

Next, an exemplary image display apparatus to which the above-described display element drive apparatus is applied will be described.

Figure 9:
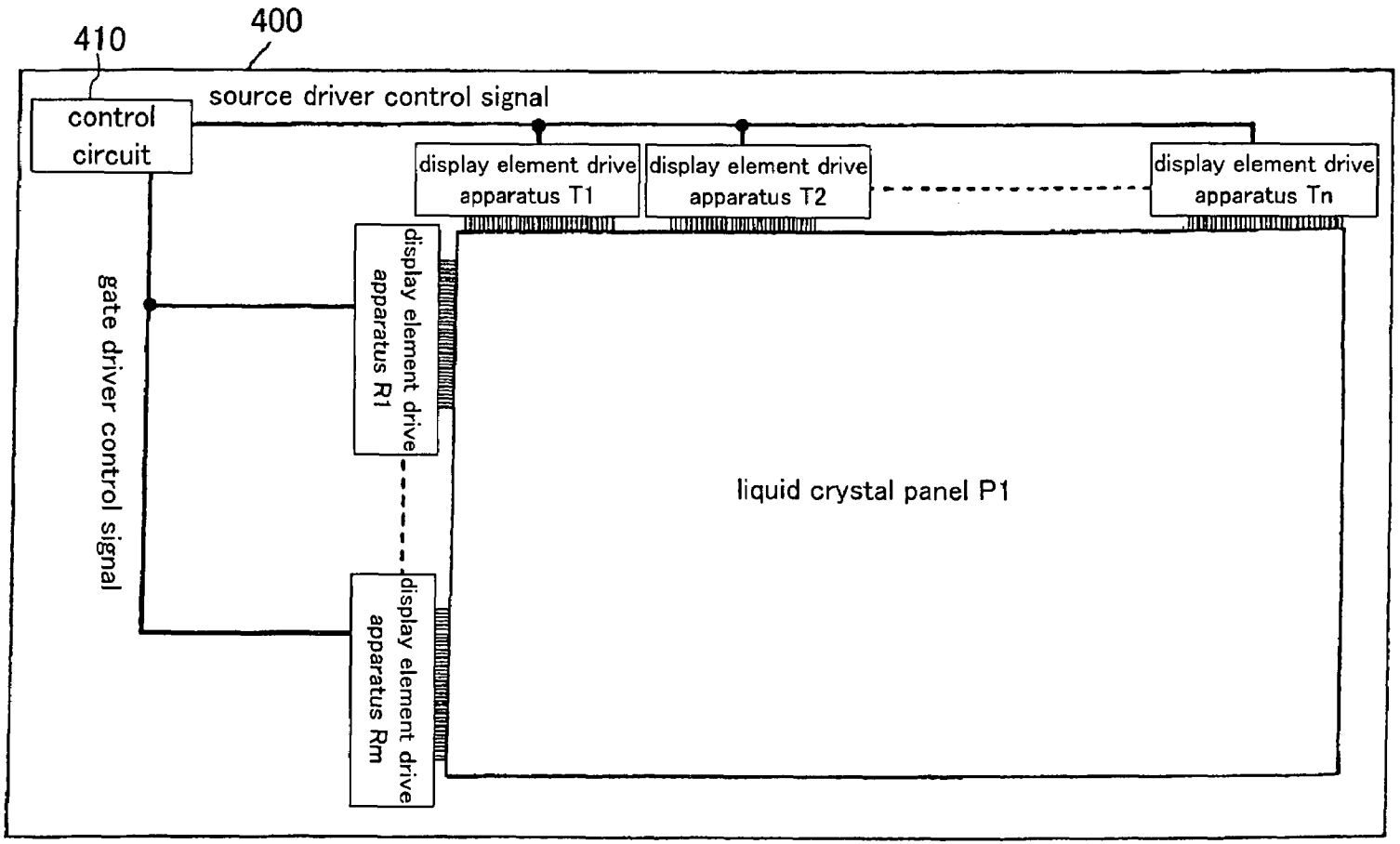
FIG. 9 is a block diagram illustrating a structure of an image display apparatus according to Embodiment 4 of the present invention.

FIG. 9 is a block diagram illustrating a structure of an image display apparatus 400 according to Embodiment 4 of the present invention. As illustrated in FIG. 9, the image display apparatus 400 comprises a liquid crystal display panel P1, a plurality of display element drive apparatuses T1, T2, . . . , Tn (n is a positive integer of 2 or more), R1, . . . , Rm (m is a positive integer of 2 or more), and a control circuit 410.

In the liquid crystal display panel P1, a plurality of image display elements (not illustrated) are provided on a display panel.

The display element drive apparatuses T1, T2, . . . , Tn supply a gray-scale voltage for the purpose of outputting display data. Specifically, each display element drive apparatus is any one of the display element drive apparatuses of Embodiments 1 to 3, and mainly comprises an input interface circuit, a shift register circuit, a data latch circuit, a D/A converter circuit, a display panel drive signal output circuit, and the like. The display element drive apparatuses T1, T2, . . . , Tn are typically called source drivers.

The display element drive apparatuses R1, . . . , Rm output a signal which scans the liquid crystal display panel P1 in a horizontal direction. Specifically, each display element drive apparatus is also any one of the display element drive apparatuses of Embodiments 1 to 3, and mainly comprises an input interface circuit, a shift register circuit, a data latch circuit, a D/A converter circuit, a display panel drive signal output circuit, and the like. The display element drive apparatuses R1, . . . , Rm are typically called gate drivers.

The control circuit 410 outputs a source driver control signal for controlling the display element drive apparatuses T1, T2, . . . , Tn, and a gate driver control signal for controlling the display element drive apparatuses R1, . . . , Rm.

In the image display apparatus 400 thus constructed, the display element drive apparatus of Embodiments 1 to 3 can be used to correctly hold a low-amplitude input signal. Therefore, a high-speed display operation can be performed, resulting in an image display apparatus capable of providing stable display which does not cause discomfort, such as flicker or the like, to the viewer.

In Embodiment 4, the display element drive apparatuses T1, T2 . . . , Tn, R1, . . . , Rm, and the control circuit 410 are constructed separately from the liquid crystal display panel P1. Alternatively, the display element drive apparatuses T1, T2 . . . ,Tn, R1, . . . , Rm, and the control circuit 410 may be integrated with the liquid crystal display panel P1. With this structure, space and material cost for the display element drive apparatuses T1, T2, . . . , Tn, R1, . . . , Rm and the control circuit 410 can be reduced, likely leading to a reduction in manufacturing cost and a reduction in the size of the display panel.

In Embodiment 4, the liquid crystal display panel P1 is used as a display panel. Alternatively, as a display panel, any display panels, such as a plasma display panel (PDP), organic and inorganic electroluminescent (EL) panels, and the like, can be used in addition to a liquid crystal display panel.

As described above, the display element drive apparatus of the present invention can correctly hold an input data signal even when an operation speed is high, and is useful as a display element drive apparatus for driving a display element on a display panel of an image display apparatus, and the like.

What is claimed is:

1. A display element drive apparatus for driving a display element formed on a display panel, comprising:

a first comparator having a positive-phase input terminal and a negative-phase input terminal, wherein a differential signal includes a pair of a first clock signal and a second clock signal, the first clock signal is input to the positive-phase input terminal, and the second clock signal is input to the negative-phase input terminal, and a voltage signal corresponding to a potential difference between the first clock signal and the second clock signal is output as a first reference clock signal;

a second comparator having a positive-phase input terminal and a negative-phase input terminal, wherein the second clock signal is input to the positive-phase input terminal and the first clock signal is input to the negative-phase input terminal, and a voltage signal corresponding to a potential difference between the second clock signal and the first clock signal is output as a second reference clock signal;

a first hold circuit of holding a data signal input in synchronization with the first reference clock signal;

a second hold circuit of holding a data signal input in synchronization with the second reference clock signal;

a third comparator, wherein a differential signal includes a pair of a first data signal and a second data signal, and a voltage signal corresponding to a potential difference between the first data signal and the second data signal is output as the data signal; and a delay circuit of delaying the data signal output by the third comparator, wherein the first hold circuit receives the data signal delayed by the delay circuit, and the second hold circuit receives the data signal delayed by the delay circuit.

2. The display element drive apparatus of claim 1, wherein an amplitude of the first clock signal and an amplitude of the second clock signal are each smaller than a potential difference between a power source potential and a ground potential of the display element drive apparatus.

3. The display element drive apparatus of claim 1, wherein the first comparator and the second comparator have the same circuit structure.

4. The display element drive apparatus of claim 1, wherein the first comparator, the second comparator and the third comparator have the same circuit structure.

5. The display element drive apparatus of claim 1, further comprising:

a first frequency dividing circuit for dividing an output signal of the first comparator, and outputting the resultant signal to the first hold circuit; and a second frequency dividing circuit for dividing an output signal of the second comparator, and outputting the resultant signal to the second hold circuit.

6. A display element drive apparatus for driving a display element formed on a display panel, comprising:

a first comparator having a positive-phase input terminal and a negative-phase input terminal, wherein a differential signal includes a pair of a first clock signal and a second clock signal, the first clock signal is input to the positive-phase input terminal, and the second clock signal is input to the negative-phase input terminal, and a voltage signal corresponding to a potential difference between the first clock signal and the second clock signal is output as a first reference clock signal;

a second comparator having a positive-phase input terminal and a negative-phase input terminal, wherein the second clock signal is input to the positive-phase input terminal and the first clock signal is input to the negative-phase input terminal, and a voltage signal corresponding to a potential difference between the second clock signal and the first clock signal is output as a second reference clock signal;

a first hold circuit of holding a data signal input in synchronization with the first reference clock signal;

a second hold circuit of holding a data signal input in synchronization with the second reference clock signal;

a third comparator having a positive-phase input terminal and a negative-phase input terminal, wherein a differential signal includes a pair of a first data signal and a second data signal, the first data signal is input to the positive-phase input terminal, and the second data signal is input to the negative-phase input terminal, and a voltage signal corresponding to a potential difference between the first data signal and the second data signal is output;

a fourth comparator having a positive-phase input terminal and a negative-phase input terminal, wherein the second data signal is input to the positive-phase input terminal and the first data signal is input to the negative-phase input terminal, and a voltage signal corresponding to a potential difference between the second data signal and the first data signal is output;

a first delay circuit of delaying the signal output by the third comparator and outputting the delayed signal as a data signal for the first hold circuit, and a second delay circuit of delaying the signal output by the fourth comparator and outputting the delayed signal as a data signal for the second hold circuit.

7. The display element drive apparatus of claim 6, wherein the first comparator, the second comparator, the third comparator and the fourth comparator having the same circuit structure.

8. The display element drive apparatus of claim 6, wherein an amplitude of the first data signal and an amplitude of the second data signal are each smaller than a potential difference between a power source potential and a ground potential of the display element drive apparatus.

9. An image display apparatus comprising:

a display panel comprising a plurality of image display elements;

a plurality of display element drive apparatuses for driving the image display element on the display panel, and a control circuit for controlling operations of the plurality of display element drive apparatuses, wherein at least one of the plurality of display element drive apparatuses comprises:

a first comparator having a positive-phase input terminal and a negative-phase input terminal, wherein a differential signal includes a pair of a first clock signal and a second clock signal, the first clock signal is input to the positive-phase input terminal, and the second clock signal is input to the negative-phase input terminal, and a voltage signal corresponding to a potential difference between the first clock signal and the second clock signal is output as a first reference clock signal;

a second comparator having a positive-phase input terminal and a negative-phase input terminal, wherein the second clock signal is input to the positive-phase input terminal and the first clock signal is input to the negative-phase input terminal, and a voltage signal corresponding to a potential difference between the second clock signal and the first clock signal is output as a second reference clock signal;

a first hold circuit of holding a data signal input in synchronization with the first reference clock signal;

a second hold circuit of holding a data signal input in synchronization with the second reference clock signal;

a third comparator, wherein a differential signal includes a pair of a first data signal and a second data signal, and a voltage signal corresponding to a potential difference between the first data signal and the second data signal is output as the data signal; and a delay circuit of delaying the data signal output by the third comparator, wherein the first hold circuit receives the data signal delayed by the delay circuit, and the second hold circuit receives the data signal delayed by the delay circuit.

10. The image display apparatus of claim 9, wherein an amplitude of the first clock signal and an amplitude of the second clock signal are each smaller than a potential difference between a power source potential and a ground potential of the display element drive apparatus.

11. The image display apparatus of claim 9, wherein the first comparator and the second comparator have the same circuit structure.

12. The image display apparatus of claim 9, wherein the first comparator, the second comparator and the third comparator have the same circuit structure.

13. The image display apparatus of claim 9, further comprising:

a first frequency dividing circuit for dividing an output signal of the first comparator, and outputting the resultant signal to the first hold circuit; and a second frequency dividing circuit for dividing an output signal of the second comparator, and outputting the resultant signal to the second hold circuit.

14. An image display apparatus comprising:

a display panel comprising a plurality of image display elements;

a plurality of display element drive apparatuses for driving the image display element on the display panel, and a control circuit for controlling operations of the plurality of display element drive apparatuses, wherein at least one of the plurality of display element drive apparatuses comprises:

a first comparator having a positive-phase input terminal and a negative-phase input terminal, wherein a differential signal includes a pair of a first clock signal and a second clock signal, the first clock signal is input to the positive-phase input terminal, and the second clock signal is input to the negative-phase input terminal, and a voltage signal corresponding to a potential difference between the first clock signal and the second clock signal is output as a first reference clock signal;

a second comparator having a positive-phase input terminal and a negative-phase input terminal, wherein the second clock signal is input to the positive-phase input terminal and the first clock signal is input to the negative-phase input terminal, and a voltage signal corresponding to a potential difference between the second clock signal and the first clock signal is output as a second reference clock signal;

a first hold circuit of holding a data signal input in synchronization with the first reference clock signal; and a second hold circuit of holding a data signal input in synchronization with the second reference clock signal;

a third comparator having a positive-phase input terminal and a negative-phase input terminal, wherein a differential signal includes a pair of a first data signal and a second data signal, the first data signal is input to the positive-phase input terminal, and the second data signal is input to the negative-phase input terminal, and a voltage signal corresponding to a potential difference between the first data signal and the second data signal is output;

a fourth comparator having a positive-phase input terminal and a negative-phase input terminal, wherein the second data signal is input to the positive-phase input terminal and the first data signal is input to the negative-phase input terminal, and a voltage signal corresponding to a potential difference between the second data signal and the first data signal is output;

a first delay circuit of delaying the signal output by the third comparator and outputting the delayed signal as a data signal for the first hold circuit, and a second delay circuit of delaying the signal output by the fourth comparator and outputting the delayed signal as a data signal for the second hold circuit.

15. The image display apparatus of claim 14, wherein the first comparator, the second comparator, the third comparator and the fourth comparator having the same circuit structure.

16. The image display apparatus of claim 14, wherein an amplitude of the first data signal and an amplitude of the second data signal are each smaller than a potential difference between a power source potential and a ground potential of the at least one display element drive apparatus.

17. The image display apparatus of claim 9, wherein the display panel, the plurality of display element drive apparatuses, and the control circuit are formed on the same substrate.

* * * * *